US006434984B1

(12) United States Patent
Juillerat et al.

(10) Patent No.: US 6,434,984 B1
(45) Date of Patent: Aug. 20, 2002

(54) DRIVE DEVICE FOR LOCKING AND UNLOCKING A LOCK WITH CONDITIONAL OPENING

(75) Inventors: Denis Juillerat; Pierre Pellaton, both of Le Locle (CH)

(73) Assignee: Ilco-Unican S.A./Relhor Division (CH)

( * ) Notice: Subject to any disclaimer, the term of this patent is extended or adjusted under 35 U.S.C. 154(b) by 0 days.

(21) Appl. No.: 09/424,775

(22) PCT Filed: May 29, 1998

(86) PCT No.: PCT/EP98/03206

§ 371 (c)(1),
(2), (4) Date: Dec. 1, 1999

(87) PCT Pub. No.: WO98/54429

PCT Pub. Date: Dec. 3, 1998

(30) Foreign Application Priority Data

May 30, 1997 (EP) ..... 97108693

(51) Int. Cl.[7] ..... E05B 47/00
(52) U.S. Cl. ..... 70/277; 70/267; 70/272
(58) Field of Search ..... 70/277, 267–274, 70/278.1, 278.7

(56) References Cited

U.S. PATENT DOCUMENTS

| | | | | | |
|---|---|---|---|---|---|
| 4,137,738 | A | * | 2/1979 | Marold | 70/274 |
| 4,633,687 | A | | 1/1987 | Fane | 70/276 |
| 4,774,512 | A | * | 9/1988 | Jolidon et al. | 70/272 X |
| 4,944,170 | A | | 7/1990 | Jolidon et al. | 70/267 |
| 4,977,765 | A | * | 12/1990 | Legault et al. | 70/268 |
| 5,307,655 | A | * | 5/1994 | Boltz et al. | 70/267 X |
| 6,032,499 | A | * | 3/2000 | Juillerat et al. | 70/267 |

FOREIGN PATENT DOCUMENTS

| | | | | |
|---|---|---|---|---|
| EP | 0 256 430 | | 2/1988 | |
| FR | 2 300 876 | | 9/1976 | |
| GB | 2038397 | * | 7/1980 | 70/267 |
| GB | 2081799 | * | 2/1982 | 70/267 |

* cited by examiner

*Primary Examiner*—Suzanne Dino Barrett
(74) *Attorney, Agent, or Firm*—Griffin & Szipl, P.C.

(57) ABSTRACT

A drive device for locking a conditionally opening lock, including a motor means (MT) comprising a drive element (36) having an axis of rotation (X1), a transmission arm (26) mounted about an axis of rotation (X2) distinct from the axis (X1), a locking block (PVI) connected mechanically to the arm (26) and adapted to occupy an active position (P1), to oppose the displacement of a bar, and an inactive position (P2) allowing displacement thereof, and elastic means (48) for putting the locking block (PVI) under bias, when the block's displacement is impeded by the bar, wherein the elastic means (48) are arranged between the drive element (36) and the transmission arm (26), these elastic means (48) being in direct driving contact with a coupling surface (54) of the transmission arm (26).

11 Claims, 8 Drawing Sheets

DRIVE DEVICE FOR LOCKING AND UNLOCKING A LOCK WITH CONDITIONAL OPENING

The present invention relates to a drive device for locking and unlocking a lock with conditional opening.

More particularly the invention relates to the application of this device to a time lock known as a high security lock, for controlling access during specified time ranges to high security enclosures, such as strong boxes or strongrooms for example of banking organisations. The invention thus also concerns the application of this device to high security enclosures, such as strong boxes or strongrooms.

One such device and a time lock of this type are described in the patent EP 0 256 430.

Figure 1A:
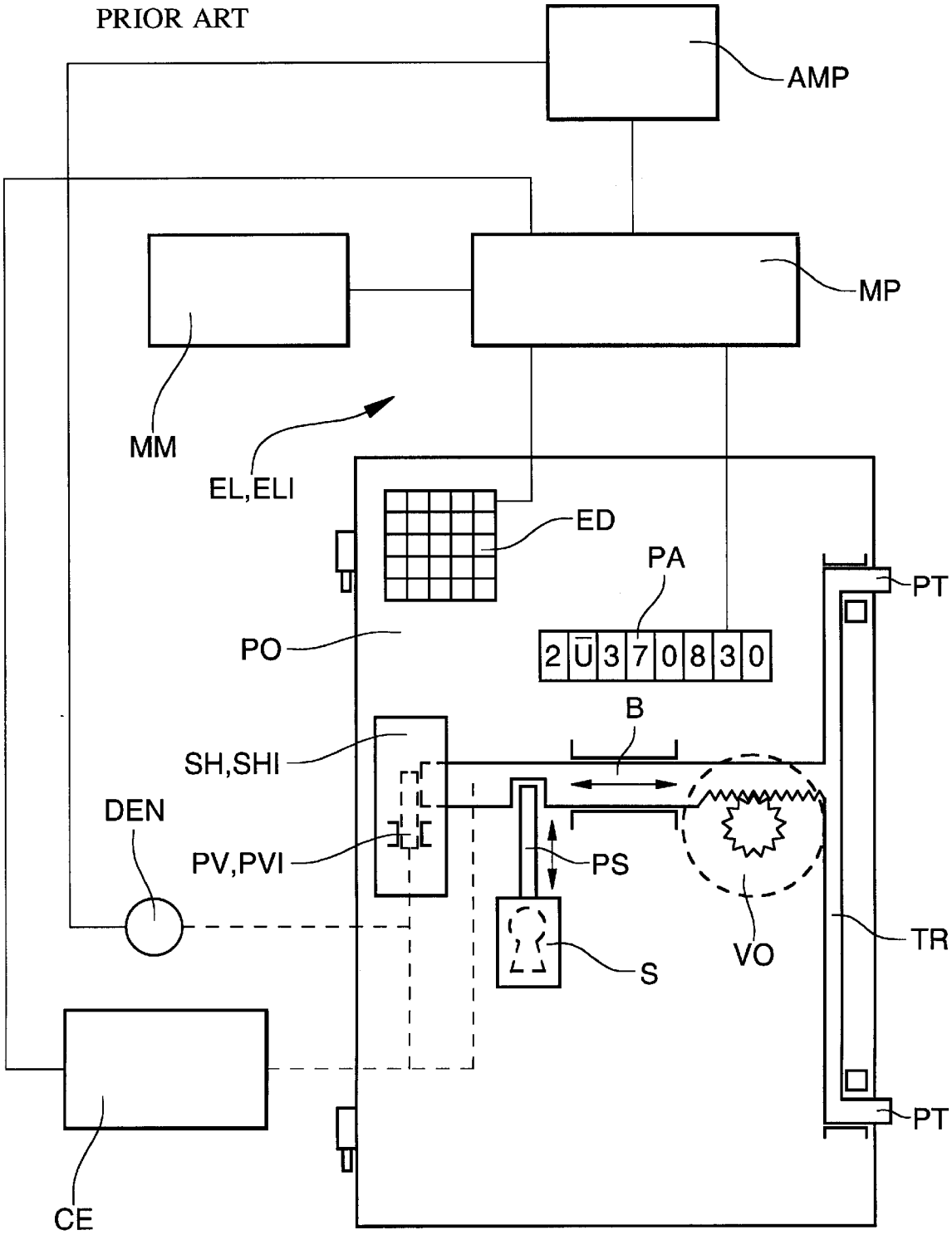
Fig. 1a PRIOR ART
Figure 1B:
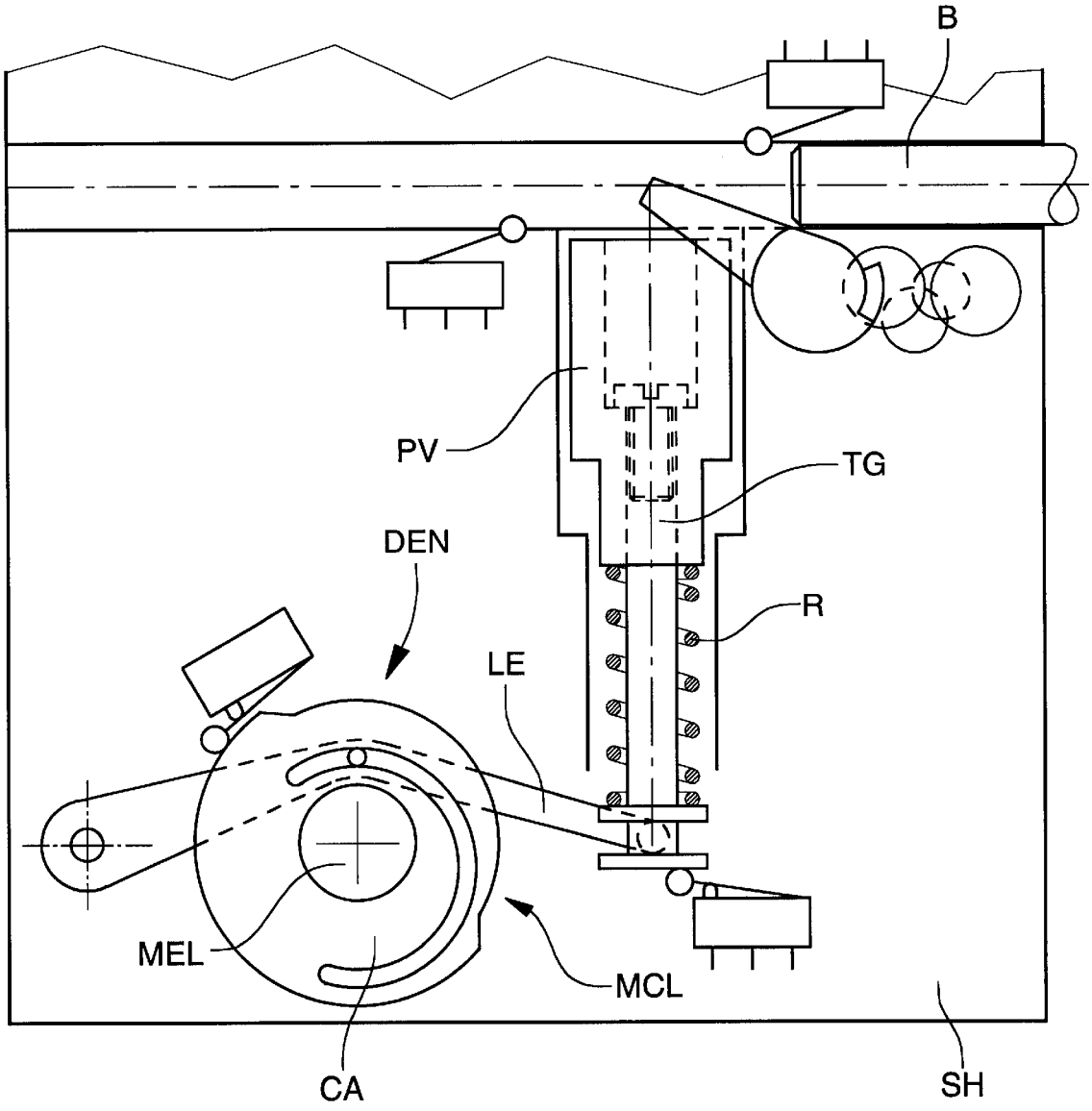
Fig. 1b PRIOR ART

A security system described in this document and incorporating this device and this lock is shown in very schematic manner in FIGS. 1*a* and 1*b* for explanatory purposes.

As described in this document and as shown in FIG. 1*a*, the closure of a door PO of a strong box or of any other high security enclosure (this door being viewed from the inside in FIG. 1*a*) generally takes place with the aid of several bolts PT controlled by a linkage TR, this linkage being adapted to be shifted by an operator with the aid of a wheel VO from a locked position to an unlocked position and conversely.

To this end, the linkage TR comprises a bar B which controls the movement of the bolts PT of the door PO and which is coupled to the wheel VO through a mechanism of rack and pinion type.

This bar B can be shifted in translation under the action of the wheel VO to effect the displacement of the bolts PT and to take care of the operations of locking (bolts extended) and unlocking (bolts retracted).

In order to prevent opening of the door PO and to hold the linkage TR in the locking position when the bolts PT are in this position, this system comprises a first lock S which is itself provided with a bolt PS for engagement in the bar B. The bolt PS is thus provided to prevent the movement in translation of the bar B.

This first lock S can be controlled in the simplest version by a key or equally by more sophisticated means, such as a magnetic card, a smart card or an electronic system operating with a code or other type of authorisation for access.

However, in order to enhance the degree of security and to prevent any fraudulent use of this first lock S, a second lock SH called a time lock is associated therewith.

This time lock SH also has his own bolt PV which is called more generally the locking bolt or block and which is arranged to be positioned in the path of the bar B in order to obstruct its movement towards the unlocking position. In the raised position of the block PV shown in FIG. 1*a*, the bar B comes into abutment with its rear end against the block PV.

The locking block PV is associated in this time lock SH with a drive device DEN, comprising in particular (FIG. 1*b*) an electromagnetic motor MEL and a mechanism MCL comprising a cam CA arranged to drive a lever LE.

Thus in normal operation, the locking block PV can occupy a high position, called the active position and shown in FIG. 1*a*, preventing movement of the bar B and blocking the door PO of the enclosure.

The block PV can be moved down into a low position called the inactive position (FIG. 1*b*), by lowering the lever LE, under the action of the motor MEL. In this low position of the block PV, the bar B can be retracted, in order to disengage the bolts PT of the linkage TR. The path of the bar B is thus freed to allow the door to be opened.

This drive device DEN can be controlled by electronic means EL (FIG. 1*a*) associated with display PA and data entry ED peripherals used for programming the time ranges. The peripherals PA and ED are formed in this example by a digital display and a keypad. The electronic means EL further comprise a microprocessor MP and a memory MM of RAM/ROM type, the microprocessor MP providing control signals, on the basis of the program stored in the memory MM, which pass through an amplifier AMP to the drive device DEN.

Accordingly it is possible with this arrangement to programme periods of time during which the locking block PV will prevent the bar B sliding, even if the opening of the first lock S is prescribed by an authorisation signal recognised as valid, i.e. by a key or a valid opening code.

Accordingly, by using this time lock SH, the security is doubled, by preventing even the authorised personnel in possession of the key or the code for the enclosure from effecting any opening in one or more judiciously chosen ranges of time.

FIG. 1*b* shows in more detail the drive device DEN which is described in the above-mentioned document EP 0 256 430. It will be seen that the locking block PV is associated with a compression spring R which is supported by a rod TG driven by the drive device DEN.

More particularly, the block PV has a longitudinal recess into which the rod TG slides, being retained by a screw.

The rod TG has a collar on its base, the spring TG being interposed between this flange and the base of the block PV. Thus, in this device, any angular movement of the cam CA under the control of the motor MEL effects rising or falling movement of the block PV, through the spring R which is mounted between the block PV and the transmission device formed by the rod TG, the lever LE and the cam CA.

If the bar B is in the path of the block PV when the block rises, the spring R is compressed under the action of the mechanism MCL, which continues its course under the drive of the motor MEL. The block PV will be able to occupy its high, active position at the instant at which the bar B is shifted into its locking position, towards the right in this example. The spring R will then give the block PV the energy which it has stored, so that the block PV finishes its course in its turn and comes to block the path of the bar B. It will be understood that this device is single action.

There also exist more complex devices with a double action, comprising a second spring fitted into the rod, which has a telescopic structure. The second spring is intended to allow the drive device to finish its course when the block PV is blocked in the high position by the bar, which abuts laterally against it and wedges it in the slide of the bar B.

This device allows the desired result to be achieved.

However, it has several disadvantages.

Thus it requires implementation of a cam, and the arrangement of two springs in the double acting version and the formation of a complex hollow rod. It is also necessary to form a passage in the locking block.

Moreover, and with reference to FIG. 1*b*, it is noted that the time lock described in the document EP 0 256 430 comprises an inhibit device INH which allows the function of the time lock to be blocked, in the case of a breakdown and through a special procedure.

The inhibit device INH thus allows the locking block PV to be moved, against the force of the spring R, from its active, high position (FIG. 1*a*) towards its low position, in which it is inactive, in order to allow the shift of the bar B and allow opening of the door PO, in order to effect the repair or repairs needed on the time lock.

When applied to a high security enclosure, such as a strong box or a strongroom, the time lock SH is disposed and arranged on the door so as to be inviolable. It is generally inaccessible from outside the enclosure.

However, any malfunction of the time lock SH when the locking block PV is in its raised position causes the bar B to be blocked. A malfunction of this type which occurs during the normal hours of opening of the enclosure seals off the door for good. The time lock SH is inaccessible to security staff and the only remedy is to destroy the door or one of the walls of the enclosure by making a hole in the wall. This type of intervention is expensive and makes the strong box or strongroom unusable for several days, even several weeks.

The inhibit device INH makes it possible to avoid this type of intervention. The device allows the bar to be unblocked, by retracting the locking block PV by an exception procedure which can be controlled from outside the enclosure. Thus, the inhibit device INH is arranged so that it can push the locking block PV down, even though the block is subjected to the bias of the compressing spring R, which tends to push it up.

As a result, it is seen that in this type of high security installation it is necessary so to arrange the drive device DEN that it allows return of the locking block PV to its inactive position, in the case of breakdown, even if the block PV is held in its active locking position by the drive device DEN.

The drive device DEN should thus be designed to allow the drive action of the inhibit device INH on the locking block PV, in the case in which this inhibit device has to move the locking block PV against the force of the spring R, in order to render this block temporarily inoperative. This arrangement must thus be reversible.

U.S. Pat. No. 4,633,687 describes a drive mechanism of a lock which can be controlled by a key. This lock is used for locking the door of a hotel in which a combined closing system is used, formed by an electronic key and a purely mechanical key associated with a card which can issue a code which can be read and processed electronically.

This mechanism comprises a control device for an auxiliary bolt, which is provided to engage in a recess formed in a disc, this disc being connected to rotate with a shaft, whose rotation which is normally effected by the key, enables the retraction of the main bolts of the door, to open it.

This control device comprises a motor which can be controlled by an electronic circuit and which can drive a toothed wheel, coupled mechanically to the auxiliary bolt through a spring and an eccentric mechanism.

This eccentric mechanism comprises a finger or lug which can slide inside an oblong groove to effect the translation of the auxiliary bolt into the recess of the disc and out of this.

Although this arrangement is compact and it avoids fitting one or more compression springs of the type of those described in the document EP 0 256 430 mentioned above, the arrangement suffers from several problems.

Thus this arrangement is provided for a traditional application to a house door. It is not adapted for application to high security locks. Thus it is noted that its eccentric mechanism does not allow the auxiliary bolt to be returned to the inactive position when it is extended at the end of its course. This arrangement is thus not reversible.

The object of the present invention is to deal with these problems by providing a compact drive device with a simple structure, which can ensure reversible movement of the locking block or bolt for unlocking the security enclosure, in particular in the case of malfunctioning.

To this end the invention provides a drive device in particular for locking a conditionally opening lock, the device comprising:

motor means with a drive element having a first axis of rotation, a transmission arm having first and second ends, this arm being mounted pivotally at its second end, about a second axis of rotation distinct from the first axis, this arm being provided with a coupling surface formed in the vicinity of the first end, a locking block connected mechanically to the motor means by means of the transmission arm, this arm being operable by the motor means to cause the block to occupy an active position, in which it opposes the displacement of a bar, and an inactive position in which it allows displacement thereof, and elastic means allowing the locking block to be put under bias when it is actuated by the motor means, in particular towards its active position and when its displacement is impeded by the bar, characterized in that the elastic means are arranged between the drive element and the transmission arm, these elastic means being in direct driving contact with the coupling surface of the transmission arm.

The invention also provides a drive device for in particular locking a conditionally opening lock, the device comprising:

motor means with a drive element, a transmission member provided with a coupling surface, a locking block connected mechanically to the motor means by means of the transmission member, this member being operable by the motor means to cause the block to occupy an active position, in which it opposes the displacement of a bar, and an inactive position in which it allows displacement thereof, and elastic means allowing the locking block to be put under bias when it is actuated by the motor means, in particular towards it active position and when its displacement is impeded by the bar, characterized in that the elastic means are arranged between the drive element and the transmission member, the transmission member being connected to the locking block through a rod or link which is articulated to the locking block.

Figure 2A:
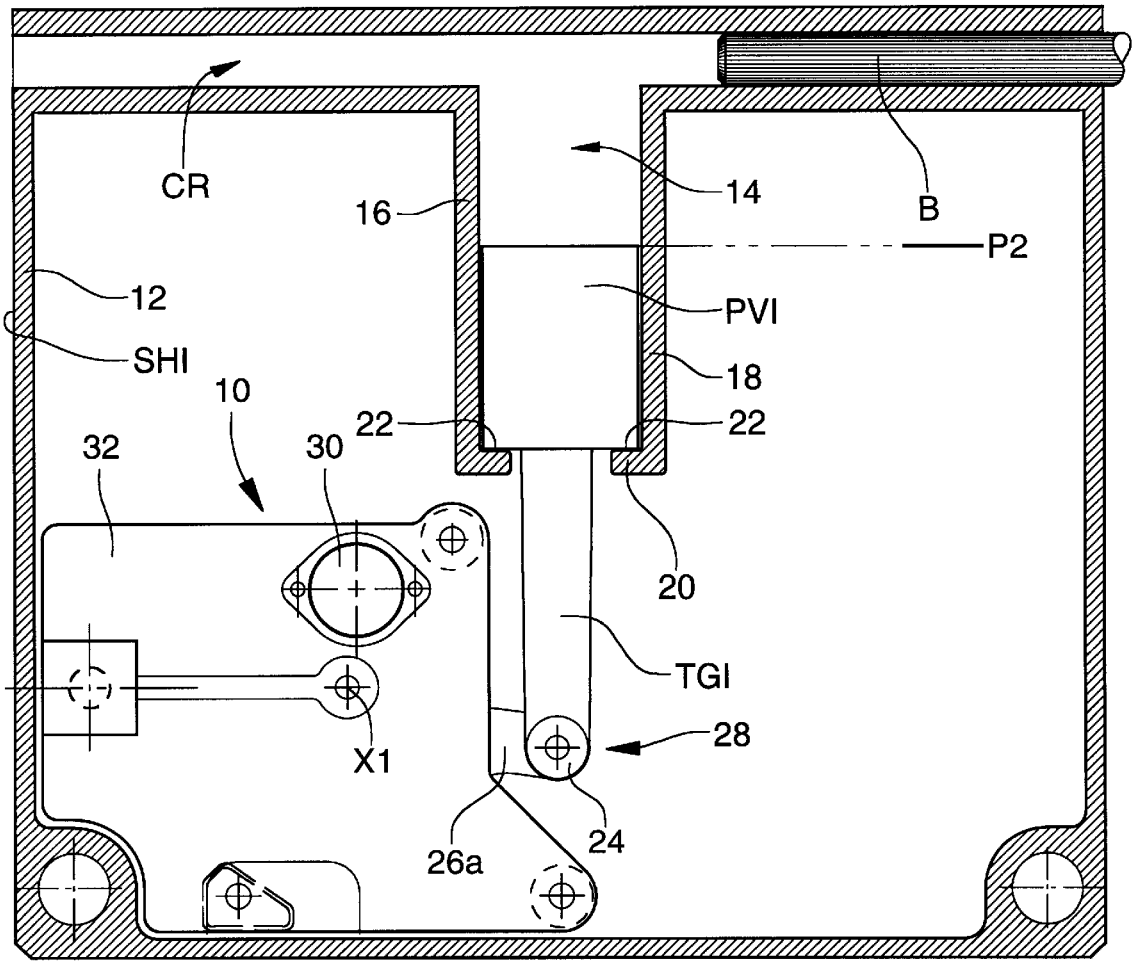
Figure 2D:
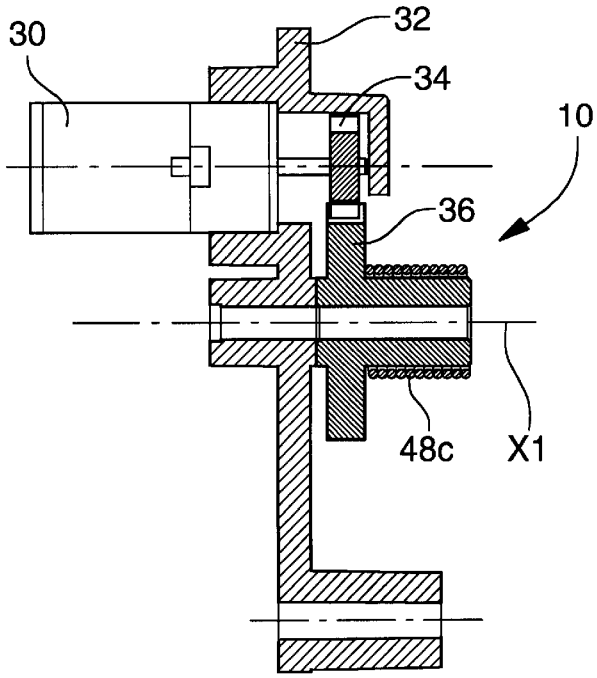
Figure 2B:
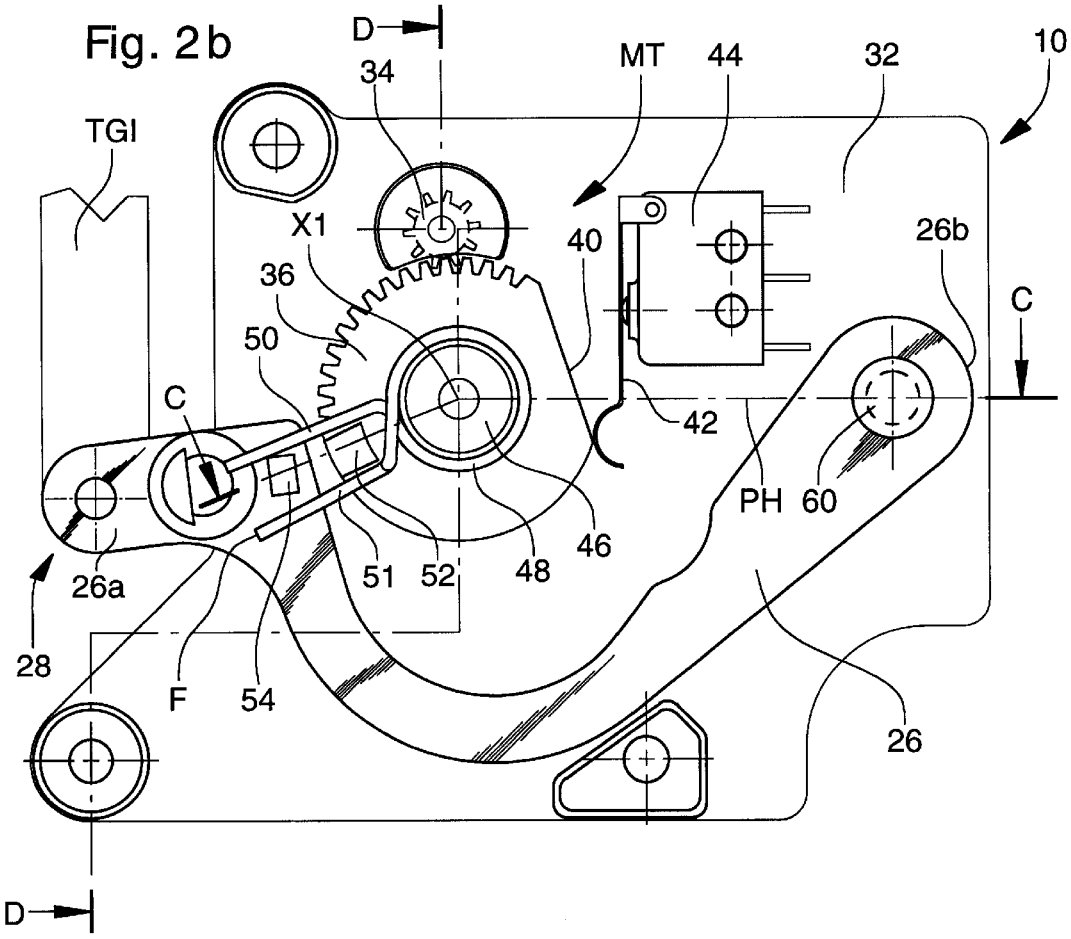
Figure 2C:
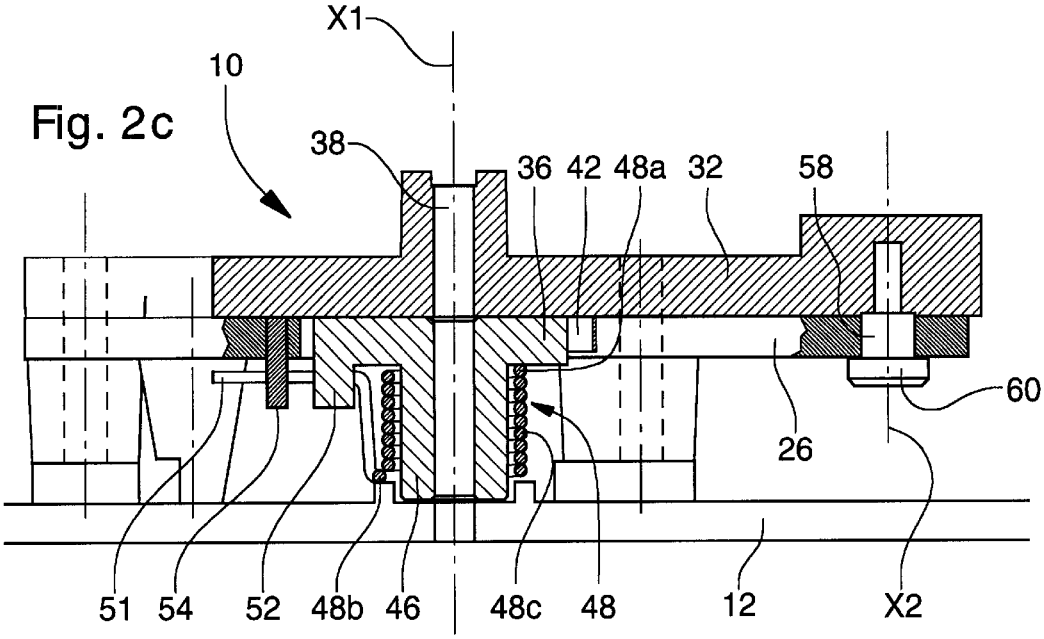
Figure 3A:
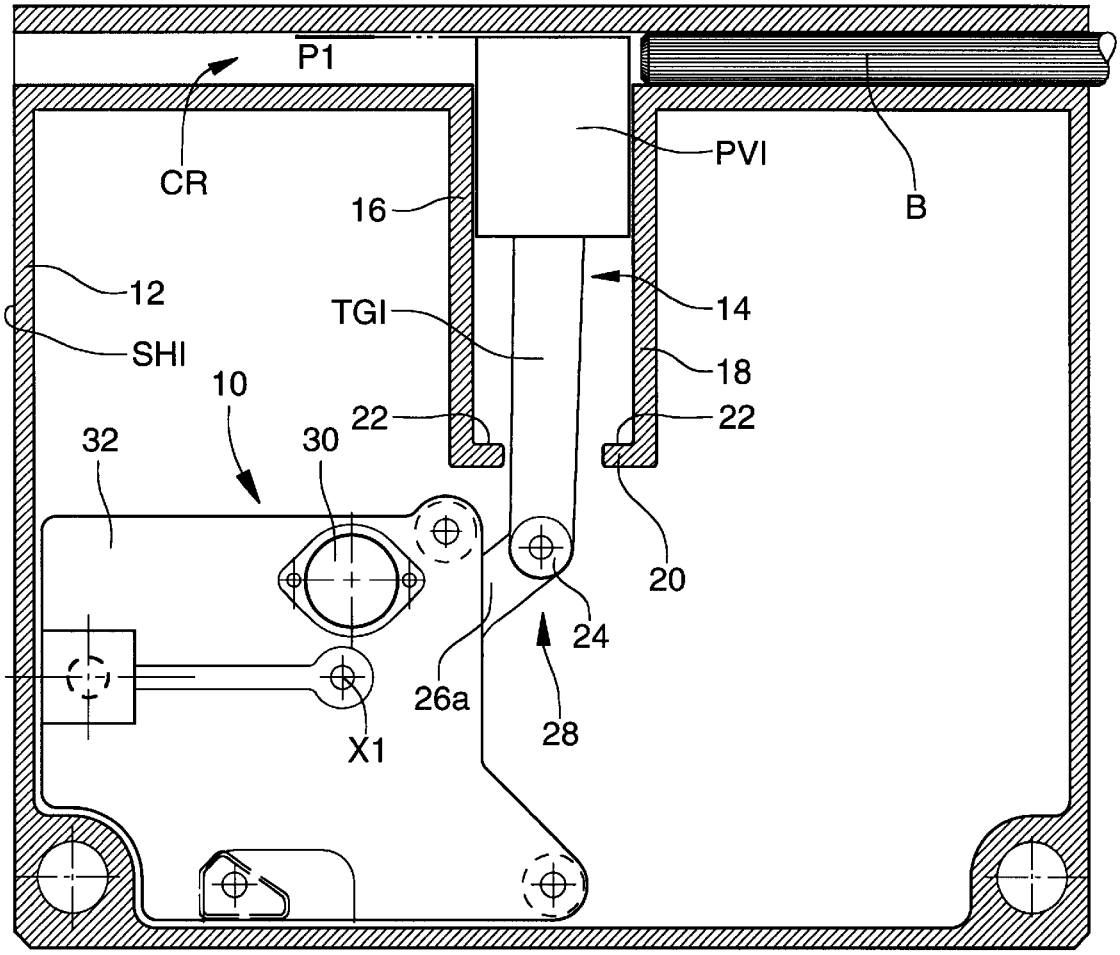
Figure 3B:
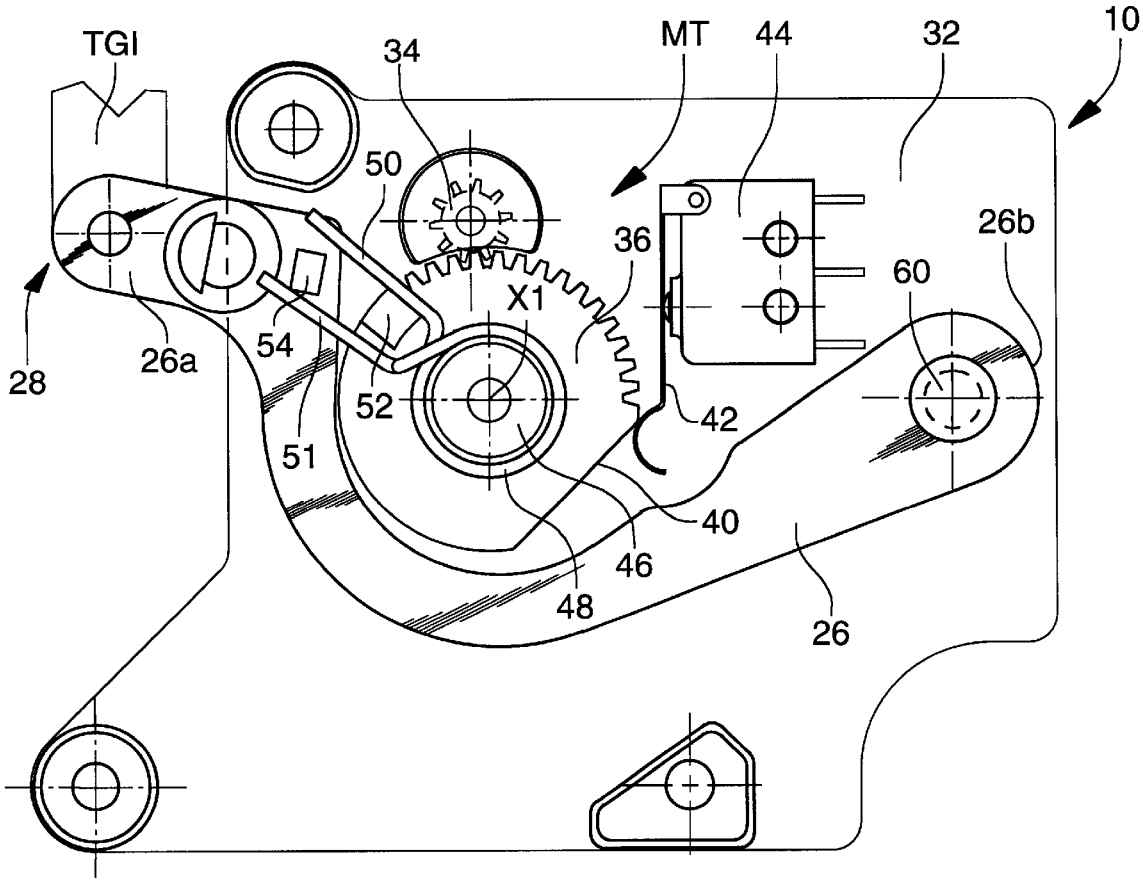
Figure 3C:
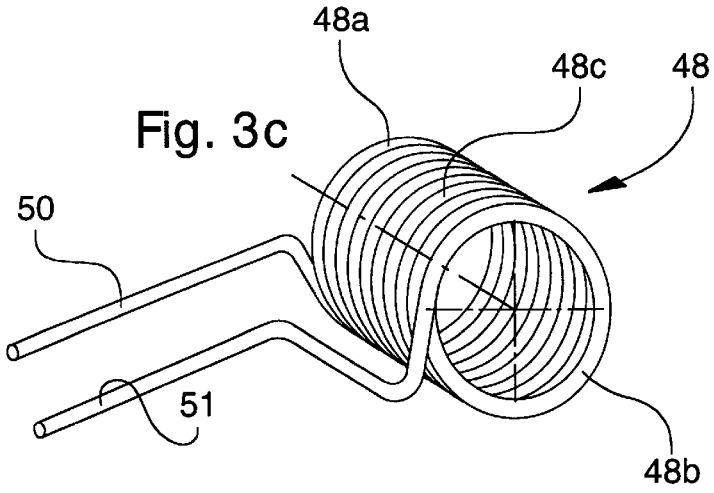
Figure 4B:
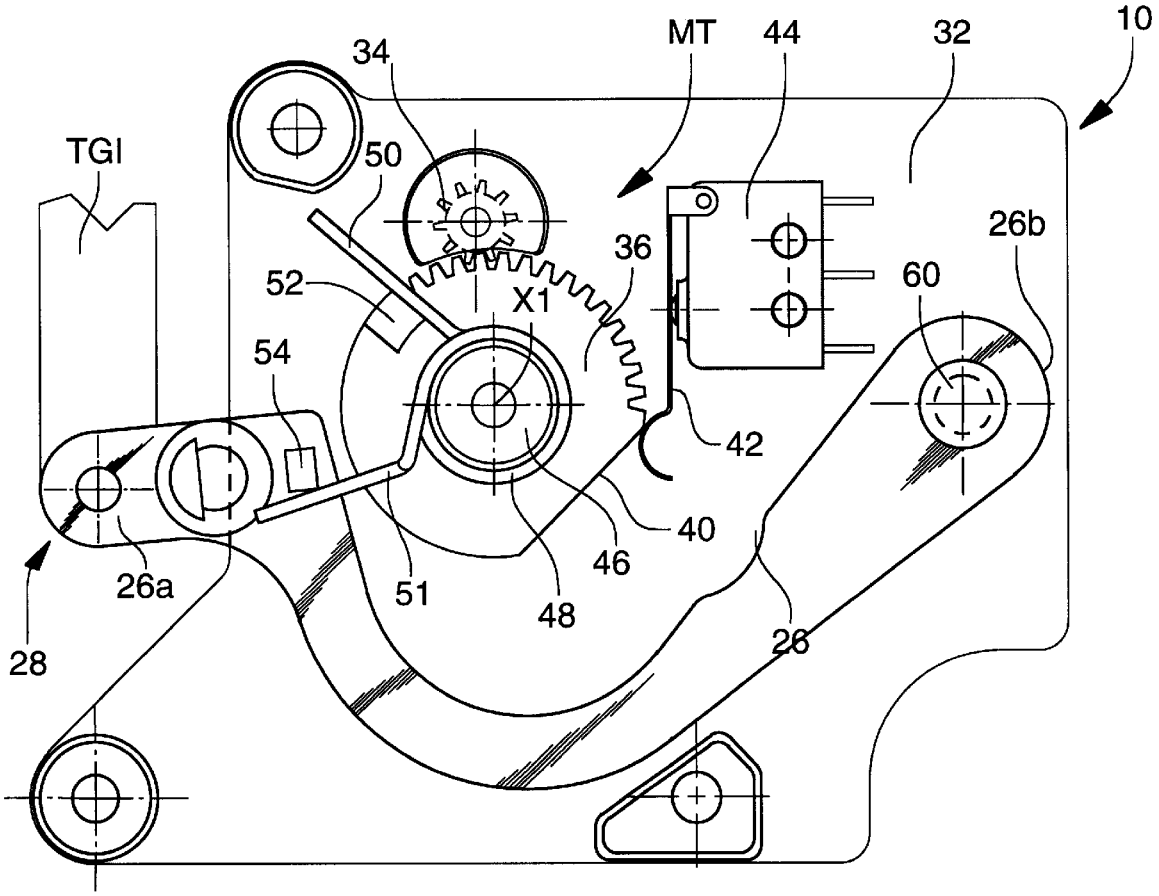
Figure 5B:
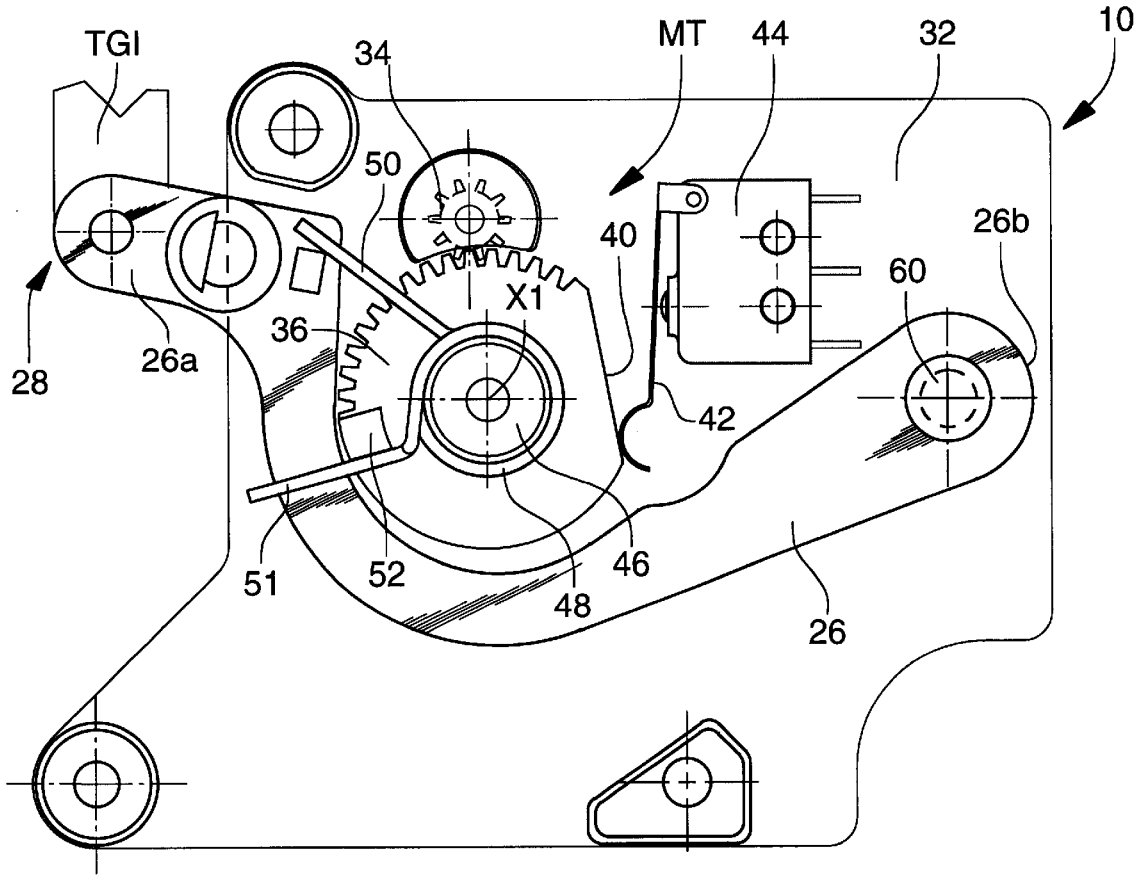

However, other features and advantages of the invention will appear from reading the detailed description which follows, given with reference to the accompanying drawings which are presented solely by way of example and in which:

FIG. 1*a* represents very schematically a conventional security assembly in which a drive device according to the invention can be incorporated, FIG. 1*b* shows the conventional drive device of FIG. 1*a* in more detail, FIG. 2*a* is a front view of a device according to the invention, incorporated in the case of a time lock and shown in a first characteristic operating position, FIG. 2*b* is a view from the rear of the device of FIG. 2*a*, shown in the same position, FIG. 2*c* is a sectioned view of the device according to the invention, taken on the line C—C of FIG. 2*b*, FIG. 2*d* is a sectional view of the device according to the invention taken on the line D—D of FIG. 2*b*, FIGS. 3*a* and 3*b* are similar views to FIGS. 2*a* and 2*b*, but showing the device according to the invention in a second characteristic operating position, FIG. 3*c* shows a spring clip in perspective, forming part of the device according to the invention, and FIGS. 4*b* and 5*b* are views similar to FIGS. 2*b* and 3*b* but showing the device according to the invention in two exception configurations, in which the rising of the locking block (FIG. 4*b*) and falling of this block (FIG. 5*b*) are prevented.

Referring now to FIGS. 2*a* to 2*d*, one embodiment of a drive device according to the invention, denoted here by the general reference 10, will be described below.

The device 10 according to the invention is fitted in a case 12 of a lock SHI which is to be fitted in a security assembly, such as that shown in FIG. 1*a*.

In this respect, it will be understood from the description which follows that the lock SHI fitted with the device 10 is modified and greatly simplified.

The lock SHI according to the invention is thus also designed to block the movement of a bar B towards its unlocking position, for example during the predetermined time ranges, in which it has been decided to prohibit opening of the door PO (FIG. 1*a*), under the same conditions as those explained above.

The invention is thus described here in its application to a time lock, since the conditions of opening and closing of the door are fixed as a function of the predetermined and programmed time ranges.

It is emphasised that this application is only given by way of example and that the invention is not restricted to this application. The invention can equally be applied to another kind of lock for which the conditions of opening and closing are related to parameters other than time or are related not solely to time parameters but also to supplementary parameters.

For this reason, the lock SHI is here qualified in a general way as a conditionally opening lock.

However, the application to a time lock forms a special and advantageous application which forms the embodiment to which reference will be made in this description.

The lock SHI comprises a locking block PVI which, in this example, is a block of parallelepipedal shape which can slide between two characteristics positions, high and low respectively, moving in a guide 14 formed by two parallel walls 16 and 18.

The block PVI is mounted in the guide 14 with appreciable operational side play, allowing it to slide without friction between its two positions.

The block PVI is shown in FIG. 2*a* in a position denoted P2, called the inactive position, in which it does not interfere with the movement of the bar B of the linkage TR.

In this position, the block PVI rests against an abutment 20, which is formed by shoulders 22 formed at the base of the walls 16 and 18.

The bar B, as mentioned above, can thus slide in a slide-way CR between its locking and unlocking positions, under the control of the wheel VO (FIG. 1*a*), in order to allow the opening or closing of the door PO by the action of the bolts PT of the linkage TR.

The locking block PVI is connected in this example by a conventional joint, not shown, to a rod or link TGI, which is itself connected by a joint or pivot 24 to a first end 26*a* of a transmission arm 26 (FIG. 2*b*). The joint or pivot 24 is formed by a pin 25 fitted and arranged to rotate freely in one or two passages 27 formed in the rod TGI and/or in the end of the transmission arm 26. The pin 25 can be attached to or integral with the rod TGI or the arm 26.

The transmission arm 26 is mounted pivotally at a second end 26*b* and it is coupled to motor means MT in the vicinity of its first end 26*a*.

The rod TGI and the transmission arm 26 form a transmission member 28 which connects the locking block PVI mechanically to the motor means MT and enables the transmission of power provided by the motor means MT to this locking block PVI.

The motor means MT comprise an electric motor 30 (FIGS. 2*a* and 2*d*), which is supplied and controlled by an electronic control unit ELI (FIG. 1*a*).

The motor 30 is mounted on a plate 32 (FIG. 2*d*), which is arranged so that it can be fixed, by screws for example, to the case 12 of the lock SHI.

In this example, the motor 30 is mounted on the plate 32 on the side opposite the transmission arm 26. This motor 30 has a motor shaft, not referenced, on the end of which is provided a drive pinion 34 (FIG. 2*d*), which emerges relative to the plate 32 on the side of the arm 26, which is the side of the plate where all the functional components of the device are located, which are designed to cooperate and put into motion.

The pinion 34 engages with a drive wheel 36 (FIG. 2*b*) on which is formed a toothed sector 35 in mesh with the teeth of the pinion 34. This wheel 36 is mounted freely rotatable on a shaft 38 (FIG. 2*c*) driven into the plate 32. The toothed sector 35 forms means for limiting the angular movement of the wheel 36.

The wheel 36 further comprises a flat 40, on which rubs a tongue 42 of a position sensor 44 adapted to provide the electronic control unit ELI with signals representing the angular position of the wheel 36. It will be understood from the description which follows that, in a normal mode of operation of the device 10 corresponding to normal drive of the block PVI, these signals are also representative of the high and low positions of the block PVI, the positions which are respectively called active (referenced P1, FIG. 3*a*) and inactive (referenced P2, FIG. 2*a*).

The position sensor 44 is in itself a sensor of conventional structure and it will not be described in more detail here.

The wheel 36 further comprises a boss 46 which extends perpendicularly from the body or plate of the wheel 36, coaxial with its geometrical axis of rotation X1.

This boss 46, which forms a drive shaft, has an elongated cylindrical form and it projects from the body of the wheel 36 in the direction of the case 12. It is noted that the shaft 38 which supports the wheel 36 rotatably passes through the plate of the wheel 36 and extends over the length of the boss 46. It is also noted that the wheel 36 and the boss 46 only form a single part, the boss 46 and the plate of the wheel 36 being made in one piece and being produced from synthetic material for example, such as polyoxymethylene, which is commonly denoted by the abbreviation POM.

A spring 48, called the spring clip, is mounted around the boss 46. This spring 48 has a body 48*c* formed by a helical coil having several turns in this example, the body 48*c* being fitted freely around the boss 46.

The spring 48 also has two radial arms 50 and 51 in the form of a fork, which are provided to drive the transmission member 28, as will be understood below.

The two arms 50 and 51 and the helical body 48*c* of the spring 48 are formed from the same elastic wire F. This wire can absorb flexional stresses and allow the two arms 50 and 51 to open under certain drive situations of the block PVI, then revert to their original configuration, after elastic deformation.

In accordance with the showing of the device in these FIG.s and the disposition given to the two arms 50 and 51, they are denoted the upper arm and the lower arm respectively.

The upper arm 50 is connected to a first turn 48*a* of the body 48*c* (FIG. 2*c*), this turn 48*a* lying alongside the plate of the wheel 36. The last turn 48*b* for its part terminates in the vicinity of the free end of the boss 46. As is seen in FIG. 3*c*, the wire F forming the spring 48 has a connecting arm 53, which connects this last turn 48*b* to the lower arm 51 and which brings this wire F back to the lower arm 51, extending alongside the body 48*c*.

Thus the two arms 50 and 51 are brought into the same plane substantially parallel to the plate of the wheel 36, by return of the wire F.

It is noted that the two arms 50 and 51 extend radially from the boss 46 in substantially parallel directions, towards a lug 52 which projects from the body or plate of the wheel 36. The lug 52 is positioned some radial distance from the boss 46 and from the axis of rotation X1 of the said wheel, in order to provide a drive couple to the transmission member 28.

The two arms 50 and 51 of the spring 48 extend on one side and the other of the lug 52 and confine this.

Accordingly, when the wheel 36 is rotated by the motor 30, via the pinion 34, it drives the spring 48 with it, more particularly its arms 50 and 51, the lug 52 pushing up or down, in the clockwise sense or anticlockwise sense, one or the other of the arms 50 and 51, depending on the sense of rotation imparted to the said wheel 36 by the motor 30.

Thus, the rotation of the wheel 36 biases the arms 50 and 51 and effects angular displacement thereof, which is simultaneous in normal operation.

The device according to the invention further comprises a finger 54 (see FIG. 2*b*) which projects, parallel to the lug 52 and parallel to the axis of rotation X1 of the wheel 36.

The two arms 50 and 51 of the spring 48 extend on one side and the other of the finger 54 and also grasp and confine this finger 54, just like the lug 52. As a result, any rotary movement of the wheel 36 in one sense or the other pushes the finger 54 up or down, via the lug 52 and via the arms 50 and 51 of the spring 48. The rotation of the wheel 36 thus has the function in normal operation of effecting a rising or falling movement of the finger 54, but with interposition in this region of the device 10 of elastic means of transmission of movement, formed in this example by the spring clip 48.

In this example, the finger 54 is integral with the transmission arm 26, which is formed by an embossed metal plate of small thickness, having a plan in the form of a "J". The bend of the arm 26 is arranged to allow it to come into the vicinity of the wheel 36, when it is in its high position (see FIGS. 3*b* and 5*b*) and to position its free end above the wheel 36. It is noted that the finger 54 forms a coupling surface between the spring 48 and the arm 26 of the transmission member 28.

This arrangement forms a compact assembly which provides an amplitude of movement enabling the block B to be placed in its two extreme positions P1 and P2.

The finger 54 is formed in the vicinity of a first free end 26*a* of the arm 26 and it can be in one piece with this arm or be driven into this.

The arm 26 is mounted at its second end 26*b* to rotate freely about a support 58 which is fixed to the plate 32 and is formed by a headed stud 60 driven into this plate. The arm 26 can thus pivot freely about an axis of rotation X2 (FIG. 2*c*) which is parallel to the axis of rotation X1 of the wheel 36.

As is seen from the Figures, the two axes of rotation X1 and X2 are positioned in a horizontal plane PH which is perpendicular to the direction of displacement of the block PVI. It is noted that the axis X2 is distinct from the axis X1 and that it is offset relative to the axis X1.

It will thus be understood that what is described as the device 10 according to the invention comprises at least two characteristic functional units, namely on the one hand the motor means MT and on the other hand the transmission member 28.

In this embodiment, the motor means MT are formed by the motor 30, the pinion 34, the wheel 36, the lug 52, the spring 48 and its two arms 50 and 51, the finger 54 being coupled to the motor means MT via the spring 48.

The transmission member 28 is formed for its part by the rod TGI, the joint 24 and the transmission arm 26.

It will thus be understood that the locking block PVI is connected to the motor means MT by way of the transmission member 28 and via the spring 48 which is interposed and arranged between these motor means MT and this transmission member 28.

The device 10 according to the invention is shown in FIGS. 2*a* to 2*d* in a first characteristic configuration, in which the block PVI is held in the low, inactive position P2, allowing the bar B to shift in the slide-way CR and to unlock the door PO.

Thus, when the electronic unit ELI commands rotation of the motor 30 out of its first position, the wheel 36 turns in the clockwise sense (FIG. 3*b*), the lug 52 pushes the upper arm 50 up, while the lower arm 51 pushes up the finger 54 and the transmission arm 26 (i.e. the whole transmission member 28) in order to raise the locking block into its active position P1 (FIG. 3*a*), where it can oppose movement of the bar B in the slide-way CR.

The sensor 44 informs the electronic unit ELI, which infers that the block PVI is in the active position P1.

When the time corresponding to barring opening of the lock SHI has elapsed, the electronic unit ELI commands rotation of the motor 30 in the reverse sense, which moves the block PVI down by the same means, into the inactive position P2, the block coming to rest against the abutment 20.

The sensor 44 informs the electronic unit ELI again and this infers that the block PVI is in the inactive position P2 and that the bar B can be moved in the slide-way CR again to open the door.

The operator can thus open the door PO (FIG. 1*a*) from this time on, obviously assuming that he has the necessary authorisation(s) for effecting opening of the lock S.

If the electronic unit causes the block PVI to rise—as it has to at the start of a time range—while the bar B is located at the same time in the slide-way CR in the region of the guide 14 (the door is thus still not locked), the block PVI will come into abutment against the bar B, the motor 30 will continue its rotation to finish its commanded course and the spring 48 will open by elastic separation of the arms 50 and 51, as shown in an exaggerated way in FIG. 4*b*. The information setting up the movement of the block PVI towards its active position P1 is stored in mechanical fashion by the spring 48. The block PVI is thus put under bias to complete its course towards its active position P1 when the bar B is shifted to the right, towards its locking position.

The same type of procedure takes place if the bar B blocks the block PVI in the high position by jamming it, when the motor 30 is turning the wheel 36 in the anticlockwise sense. As shown in FIG. 5*b*, the arms 50 and 51 of the spring are likewise spaced apart, while the wheel 36 finishes its course under the drive of the motor 30. When the bar B is shifted to the right, towards its locking position, the block PVI will be moved down by the action of the spring 48 and, in this example, also by the combined action of gravity, because of its own weight.

Thus it will be understood that in this arrangement the motor means MT are coupled to the locking block PVI by way of the spring 48 which forms a direct elastic connection between the motor means MT and the transmission member 28.

It will be understood from what has been described that the elastic means 48 in this arrangement are associated functionally and structurally with the motor means MT and are integrated into the same module, these motor means MT and the elastic means 48 being fixed to the same plate. It is also noted that the elastic means 48 are supported by the motor means MT by being mounted on the drive shaft or boss 46.

The embodiment which has been described is a double acting device, since it ensures that the rod TGI and the block PVI are biased to rise and to fall. The invention is applicable to a single acting device, in a simplified version which can comprise only a single arm, namely the lower arm 51, the opposed free part of the wire of the spring 48 being, in this un-illustrated variant, anchored in a hole or groove formed in the body or the boss of the wheel 36. In another variant, also not shown, of a single acting device, the spring 48 could also have two arms 50 and 51, the upper arm 50 which cooperates with the lug 52 being shorter than the arm 51 in this variant and not reaching to the region of the finger 54 so as to leave this free.

Under these conditions, the lower arm 51 will be moved down by the motor means MT if the block PVI is jammed in the high position, but neither of the arms will bias the finger 54. The block PVI will be able to return later to the low position under the sole action of gravity, because of the movement of the bar B, the lower arm 51 encountering the finger 54 during its descent.

It will thus be understood that a drive device has been described above and shown in the FIGURES, particularly for locking a lock with conditional opening, of simple and compact design ensuring reversibility of the movement of the locking block.

What is claimed is:

1. A drive device for locking a conditionally opening lock, the device comprising:

motor means with a drive element;

a transmission member (28) provided with first and second ends, a coupling surface disposed in the vicinity of the first end, the transmission member being pivotally mounted at the second end, a locking block connected mechanically to the motor means by means of the transmission member, this member being operable by the motor means to cause the block to occupy an active position, in which the block opposes the displacement of a bar, and an inactive position (P2) in which the block allows displacement of the bar; and elastic means allowing the locking block to be put under bias when the block is actuated by the motor means, towards the active position and when displacement of the block is impeded by the bar, wherein the elastic means are arranged between the drive element and the transmission member, the transmission member being connected to the locking block through a rod or link which is articulated to the locking block.

2. A device according to claim 1, wherein the rod or link is connected to the transmission member by a joint or pivot.

3. A device according to claim 1, wherein the drive element is formed by a wheel, on which are provided means for limiting the angular movement of the said wheel.

4. A device according to claim 3, wherein the limiting means are formed by a toothed sector formed on the wheel, this sector being in mesh with the teeth of a pinion of the motor means.

5. A device according to claim 1, wherein the elastic means are formed by a helical spring acting in flexion, this spring having two arms in the form of a fork, between which are disposed the coupling surface and a lug integral with the drive element.

6. A device according to claim 3, wherein the two arms are brought by a connecting arm into the same plane substantially parallel to a plate of the wheel.

7. A conditionally opening lock and/or a time lock including a device as claimed in claim 1.

8. A high security enclosure including a device such as claimed in claim 1.

9. A device according to claim 1, wherein the coupling surface is formed by a finger provided on the transmission arm, this finger cooperating with the arm or the two arms of the elastic means and ensuring that the transmission arm is entrained by the arm or arms of the elastic means.

10. A device according to claim 5, wherein the elastic means are arranged to effect opening of the fork formed by the arms when the locking block is put under bias.

11. A device according to claim 5, wherein the spring is positioned around a shaft formed on the drive element.

* * * * *